US007295179B2

(12) United States Patent
Dunn

(10) Patent No.: US 7,295,179 B2
(45) Date of Patent: Nov. 13, 2007

(54) FLAT PANEL DISPLAY HAVING MULTIPLE DISPLAY AREAS ON ONE GLASS SUBSTRATE

(75) Inventor: William R. Dunn, Alpharetta, GA (US)

(73) Assignee: American Panel Corporation, Alpharetta, GA (US)

( * ) Notice: Subject to any disclaimer, the term of this patent is extended or adjusted under 35 U.S.C. 154(b) by 0 days.

(21) Appl. No.: 10/355,680

(22) Filed: Jan. 31, 2003

(65) Prior Publication Data

US 2004/0150582 A1 Aug. 5, 2004

(51) Int. Cl.
*G09G 3/36* (2006.01)

(52) U.S. Cl. ..... 345/102; 345/3.1; 345/903

(58) Field of Classification Search ..... 345/1.3, 345/102, 103, 903
See application file for complete search history.

(56) References Cited

U.S. PATENT DOCUMENTS 4,740,786 A * 4/1988 Smith ..... 345/3.1
4,878,086 A * 10/1989 Isohata et al. ..... 355/77
5,617,113 A * 4/1997 Prince ..... 345/103
5,805,117 A 9/1998 Mazurek et al. ..... 345/1
5,889,568 A * 3/1999 Seraphim et al. ..... 349/73
6,249,329 B1 6/2001 Dabral et al. ..... 349/73
6,259,497 B1 * 7/2001 McDonnell et al. ..... 349/73
6,341,879 B1 1/2002 Skinner et al. ..... 362/295
6,825,829 B1 * 11/2004 Albert et al. ..... 345/107
2004/0008155 A1 * 1/2004 Cok ..... 345/1.3
2004/0075623 A1 * 4/2004 Hartman ..... 345/1.3

OTHER PUBLICATIONS

Greene, R. G. et al., Seamless Tiling Technology for Large Direct-View Color AMLCD's, SID 00 Digest, Oct. 2, 2002, 3 pp.
http://tftlcd.kyunghee.ac.kr/research/poly-Si/chapter1.html, Chapter 1 Introduction, Basic Concept of TFT-LCD, Oct. 2, 2002, 8 pp.

* cited by examiner

*Primary Examiner*—Richard Hjerpe
*Assistant Examiner*—Kimnhung Nguyen
(74) *Attorney, Agent, or Firm*—Stanley Law Group LLP

(57) ABSTRACT

A flat panel display having a single back glass substrate and a single color filter passive plate divided into multiple, electrically isolated, separately addressable, functional sections having no visible seam between sections.

15 Claims, 4 Drawing Sheets

FLAT PANEL DISPLAY HAVING MULTIPLE DISPLAY AREAS ON ONE GLASS SUBSTRATE

BACKGROUND AND SUMMARY OF THE INVENTION

The present invention relates to a flat panel display having multiple, and independent, display areas integrated on one glass backplane. The flat panel display of the present invention provides a continguous, large image, or independent video scenes. In addition to the features mentioned above, objects and advantages of the present invention will be readily apparent upon a reading of the following description.

In one embodiment, the flat panel display of the present invention, having a front display area and a back portion, is comprised of:

a first glass substrate having at least two separately addressable sections, the separately addressable sections including a first section and a second section;

a second glass substrate and wherein a liquid crystal layer is sandwiched between the first and second glass substrates;

wherein the first and second glass substrates are of a one-piece construction; and wherein there is no visible seam between the first and second sections when viewing the flat panel display in operation.

BRIEF DESCRIPTION OF THE DRAWINGS

Novel features and advantages of the present invention, in addition to those mentioned above, will become apparent to those skilled in the art from a reading of the following detailed description in conjunction with the accompanying drawings wherein similar reference characters refer to similar parts and in which.

DETAILED DESCRIPTION OF PREFERRED EMBODIMENT(S)

The preferred system herein described is not intended to be exhaustive or to limit the invention to the precise forms disclosed. They are chosen and described to explain the principles of the invention, and the application of the method to practical uses, so that others skilled in the art may practice the invention.

The present invention relates to a single display, using a single motherglass substrate and, preferably a single color filter passive plate, that is divided into multiple, preferably electrically isolated, functional sections. Accordingly, there will be no seal between sections. A few advantages of dividing the screen into multiple screens is:

Real world redundancy (if one section of the display, its backlight or associated graphics/video processor fails, the other section(s) keep on functioning). In an alternative embodiment, the separate sections of the display are not electrically isolated;

Reduced electromagnetic interference (EMI) emissions—preferably, pixel clock frequency is reduced by a factor of two each time the number of sections is doubled;

Reduces the burden or processing horsepower required by the graphics generator or video generator (like EMI, preferably the horsepower required is reduced by a factor of two each time the number of sections is doubled);

Reduction in system weight, volume, cost and/or instrument panel consumption for a given total display area (i.e., one large sectioned display in a single chassis weighs less, occupies less volume and instrument panel space, and costs less than multiple displays having multiple chassis).

With the present invention there is no visible "seam" between the sections. With synchronized graphics processors the viewer could see one continuous, large image, or totally independent video scenes, from independent video sources/processors, which could be viewed on each section.

Figure 1:
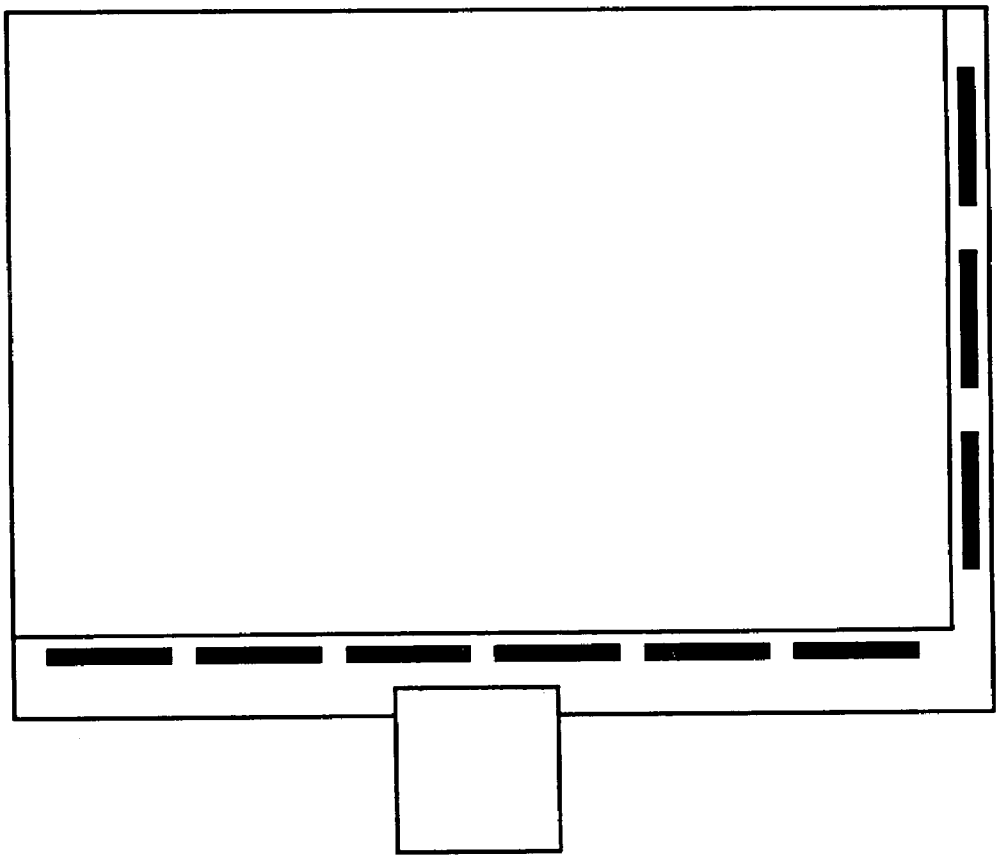
(Prior Art) FIG. 1
FIG. 1 illustrates a top plan view of one embodiment of a known display system.

FIG. 1 illustrates a block schematic of a typical "standard" single bank liquid crystal display.

Figure 2:
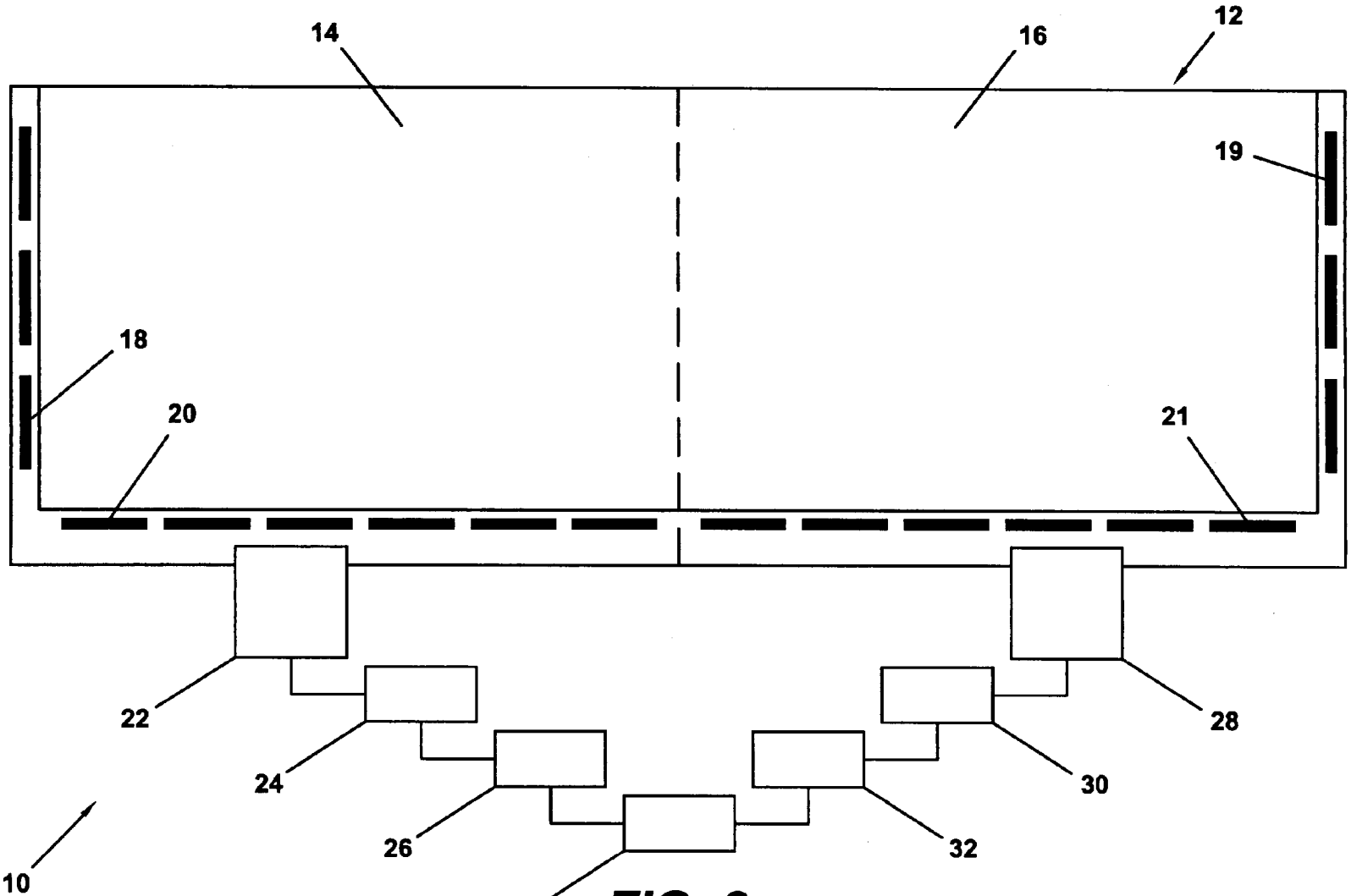
FIG. 2 illustrates a top plan view of one embodiment of the flat panel display of the present invention.

FIG. 2 illustrates a block schematic of one embodiment of the flat panel display of the present invention 10. FIG. 2 illustrates two independent "single bank" liquid crystal displays (LCDs) (preferable active matrix liquid crystal displays (AMLCDs) on one motherglass substrate or backplane 12. The display is divided into two sections 14, 16 which are preferably electrically independent. In this embodiment, each display section has separate gate drivers 18, 19 and source drivers 20, 21 on the glass substrate (accordingly each display area is separately addressable). In the preferred embodiment, the display would be integrated into one chassis (not shown). The display sections would also preferably each have its own flex interface input 22, 28 power supply, backlight, video interface 24, 30 and graphics processor 26, 32. These components may also be connected to a system processor 33. These electronic components and circuitry are well known in the art and commercially available components. For example, U.S. Pat. No. 6,111,560, incorporated by reference herein, teaches one example of a liquid crystal display.

In the embodiment of FIG. 2, the gate and source drivers are placed on the back glass substrate 34. Since the substrate is one piece, there are no visible seams in the display or in-between the display sections 14, 16 (the dividing point between the two display sections is shown as a dotted line in FIG. 2 indicating that it is not visible to the viewer). In the preferred embodiment, the front glass 40 having color filters is also of a one-piece construction.

Figure 3:
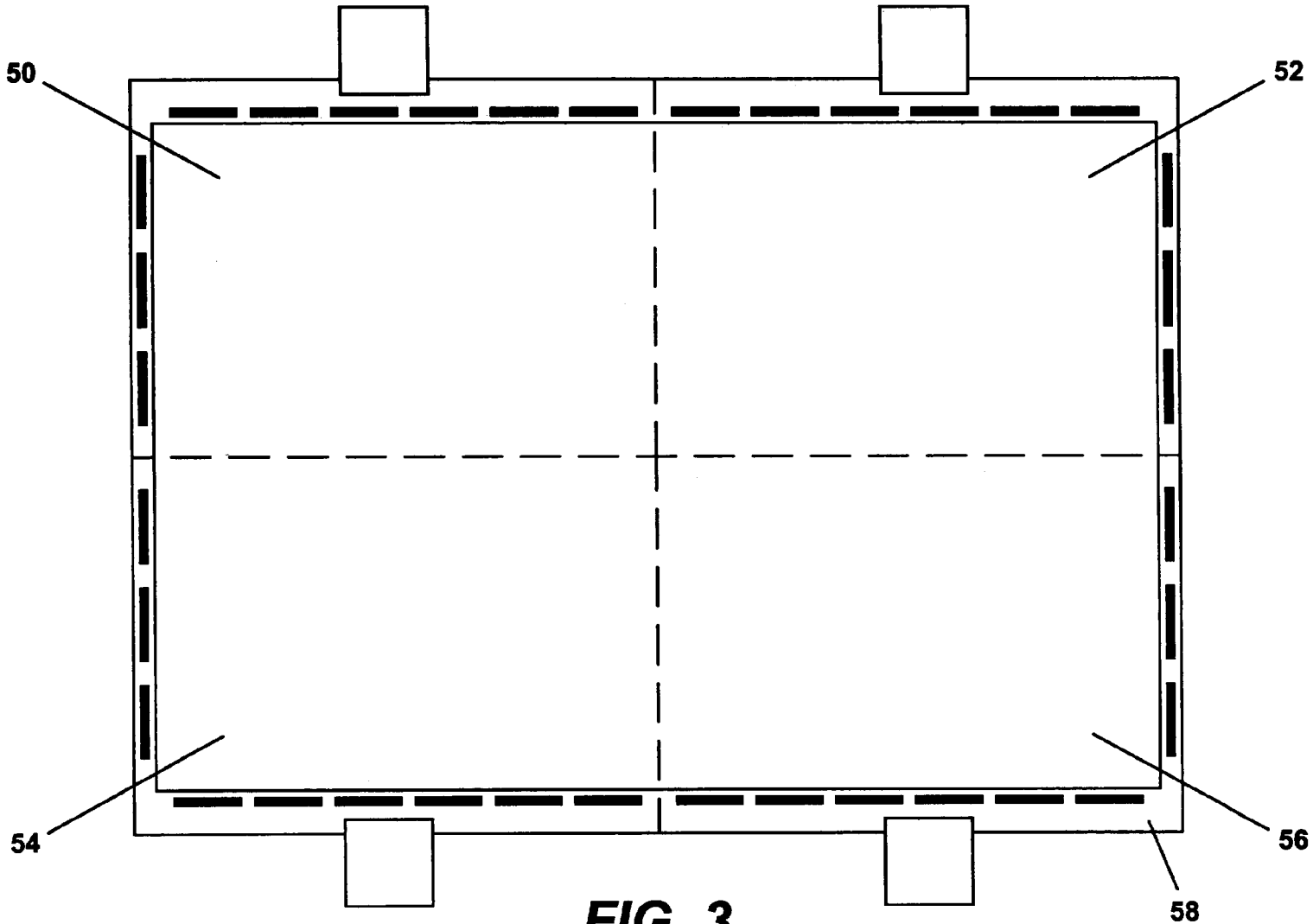
FIG. 3 illustrates a top plan view of another embodiment of the flat panel display of the present invention.

FIG. 3 illustrates a block diagram of another embodiment of the flat panel display of the present invention. FIG. 3 illustrates four independent "single bank" liquid crystal displays (LCDs) (preferably active matrix liquid crystal displays (AMLCDs)) on one motherglass substrate or backplane. The display is divided up into four sections 50, 52, 54, 56 (associated electronics not shown). In the embodiment of FIG. 3, the gate and source drivers are placed on the back glass substrate 58. Since the substrate is one piece, there are no visible seams in the display or in-between the display sections (the dividing point between the four display sections is shown as a dotted line in FIG. 3 indicating that it is not visible to the viewer). In the preferred embodiment, the front glass 40 having color filters is also of a one-piece construction.

Figure 4:
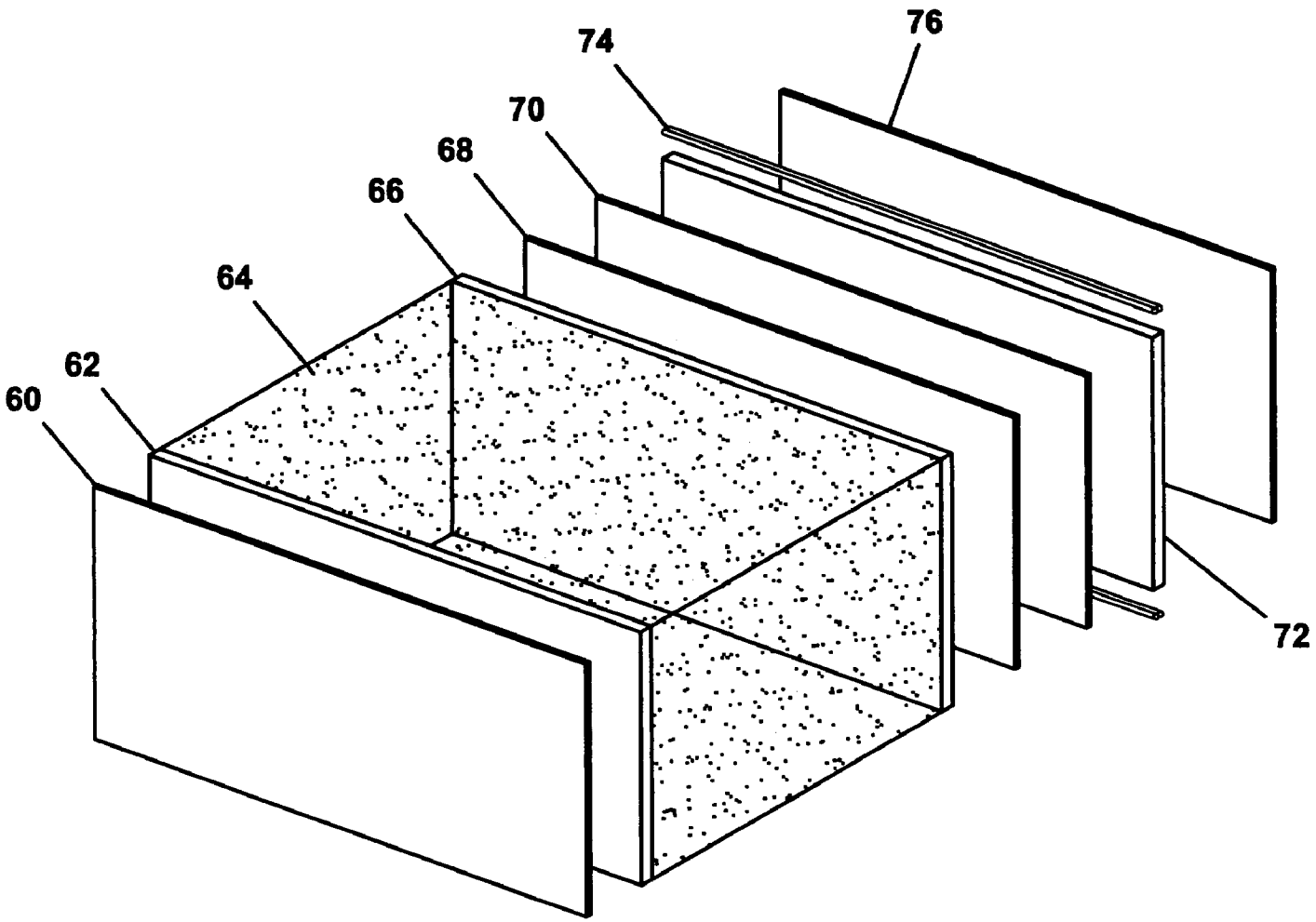
FIG. 4 illustrates an exploded view of one embodiment of a liquid crystal display.

FIG. 4 illustrates an exploded view of one embodiment of a liquid crystal display of the present invention. Typical layers of the display include a front polarizer 60, front glass substrate 62, preferably with color filters, liquid crystal layer 64, back glass 66 with TFT circuitry, rear polarizer 68, a diffuser 70, an extraction pattern layer 72, a light 74 and reflector 76.

In a typical normal mode, the display may operate as a single wide screen panoramic (e.g., 2 section) or large display (e.g., 4 section). One display could replace multiple (e.g., 2-4) independent displays providing equal or greater image area in less space, at lower cost, with no mullions or visible interruptions between adjacent sections.

The present invention provides built-in redundancy. For example, each section is preferably electrically independent from the other sections (e.g., AMLCD, backlight, heater, video/graphic input, graphic/video processor, and power supply) so that if one section fails the other(s) keep(s) operating.

The present invention also reduces the burden of the graphics processor. For example, in the preferred embodiments, each graphics processor drives a portion of the image (e.g., ½ the load per processor on a 2 section AMLCD backplane and ¼ the load on a 4 section AMLCD backplane). Therefore, the present invention has 2-4 times the image update rate for a given graphics processor, or the same image update rate using a less expensive graphics processor.

The present invention also provides a low EMI and/or image noise. For example, the image pixel clock preferably runs at ½ (2 section) or ¼ (4 section) the rate required for "normal" AMLCD of the same physical size and resolution, respectively for the embodiments of FIGS. 2 and 3.

The examples below illustrate specific example embodiments of the present invention.

2 Independent AMLCDs on 1 Glass Backplane:

As an example, replace three 8.00"v×6.00" 1024×768 AMLCDs (requires 9.00"×21.00" of panel space & provides 144 $in^2$ of image area), with one 8.00"×20.00" 1024×1280×2 on one backplane (requires same ~9.00"×21.00" of panel space & but provides 11% larger 160 $in^2$ of image area). Replace the 3 chassis, 3 power supplies, 3 AMLCDs, 3 backlights, 3 GPs, etc. with 1 AMLCD, 1 chassis, 2 power supplies, 2 backlights, 2 GPs, etc.

For example, two 42" 16:9 aspect ratio AMLCDs may be installed on a 1.0×1.2 meter mother glass (or another alternative is one 60" diagonal on this motherglass). Other examples include a 1.10×1.25 meter mother glass; or 1.50×1.85 meter mother glass (capable of two 67" diagonal or one 92" diagonal display from one motherglass).

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A flat panel display comprising:

a first and a second substrate with a unitary layer of liquid crystal material sandwiched therebetween;

from two to four uniquely addressable display sections arranged in the liquid crystal material, said uniquely addressable display sections having a unique set of gate drivers and source drivers uniquely addressable;

wherein said uniquely addressable display sections being electrically separate and independent of each other;

wherein said first and second substrates are each of a one-piece construction; and wherein there is neither a physical nor visible seam between the uniquely addressable display sections when viewing said flat panel display in operation.

2. The flat panel display according to claim 1, wherein the viewer can view one continuous large image on all of the uniquely addressable display sections or independent video scenes on each of the uniquely addressable sections.

3. The flat panel display according to claim 1, wherein said flat panel display is redundant in that if one of the uniquely addressable display sections fails, at least one other uniquely addressable display section continues to operate.

4. The flat panel display according to claim 1, wherein said first substrate has gate drivers on the edge and source drivers on another edge.

5. The flat panel display according to claim 1, wherein said first section is further comprised of:

a first power supply for powering said first section;

a first backlight adapted to provide light to said first section;

a first graphics processor for sending signals to said first section;

and wherein said second section is further comprised of:

a second power supply for powering said second section;

a second backlight adapted to provide light to said second section;

a second graphics processor for sending signals to said second section.

6. The flat panel display according to claim 5, wherein said flat panel display is incorporated into one chassis.

7. A flat panel display comprising:

a first glass substrate having at least two electrically separate and independent sections, each said electrically separate and independent section having one or two uniquely addressable display areas;

wherein said first glass substrate is of a one-piece construction; and wherein there is neither a physical nor visible seam between any of the uniquely addressable display areas when viewing said flat panel display in operation.

8. The flat panel display according to claim 7, wherein each uniquely addressable display area is addressed by a set of gate drivers and source drivers.

9. The flat panel display according to claim 7, further comprised of a second glass substrate and wherein a liquid crystal layer is sandwiched between said first and second substrates.

10. The flat panel display according to claim 9, wherein said second glass substrate is of a one-piece construction.

11. The flat panel display according to claim 7, wherein said first section is further comprised of:

a first power supply for powering said first section;

a first backlight adapted to provide light to said first section;

a first graphics processor for sending signals to said first section;

and wherein said second section is further comprised of:

a second power supply for powering said second section;

a second backlight adapted to provide light to said second section;

a second graphics processor for sending signals to said second section; and wherein said flat panel display is redundant in that if the first section fails, said second section continues to operate.

12. The flat panel display according to claim 11, wherein said flat panel display and all its components are incorporated into one chassis.

13. A flat panel display comprising:

a first and a second substrate with a unitary layer of liquid crystal material sandwiched therebetween;

a first and second uniquely addressable display section arranged in the liquid crystal material, said uniquely addressable sections being electrically insulated and independent of each other;

wherein said first and second substrates are each of a one-piece construction; and wherein there is neither a physical seam nor visible seam between the uniquely addressable display sections when viewing said flat panel display in operation.

14. The display of claim 13 wherein the first display section is further comprised of:

a first power supply for powering said first section;

a first backlight adapted to provide light to said first section; and a first graphics processor for sending signals to said first display section; and wherein said second display section is further comprised of:

a second power supply for powering said second section;

a second backlight adapted to provide light to said second section;

and wherein said flat panel display is redundant in that if the first section fails, said second section continues to operate.

15. The display of claim 14 wherein said first and second power supplies, said first and second backlights, and said first and second graphics processors are each electrically independent of each other.

* * * * *

UNITED STATES PATENT AND TRADEMARK OFFICE

CERTIFICATE OF CORRECTION

PATENT NO. : 7,295,179 B2
APPLICATION NO. : 10/355680
DATED : November 13, 2007
INVENTOR(S) : William Dunn It is certified that error appears in the above-identified patent and that said Letters Patent is hereby corrected as shown below:

Title page;
At 74, Attorney, Agent, or Firm, please delete "Stanley Law Group LLP", and insert --Standley Law Group LLP--

In Other Publications page 1, please insert --KRUSIUS et al., Seamless Tiling of AMLCDs for Large Area Dsplays, Rainbow Displays, Inc. SID 02 Digest, 10/02/2002, 6pp--

Signed and Sealed this

Fifteenth Day of April, 2008

JON W. DUDAS
*Director of the United States Patent and Trademark Office*